United States Patent [19]

Chase et al.

[11] 4,200,206

[45] Apr. 29, 1980

[54] SHOWER ATTACHABLE DISPENSER

[76] Inventors: Charles R. Chase, 2253 W. St. Moritz La., Phoenix, Ariz. 85023; Gerald F. Lantry, 2002 Ave. G., Council Bluffs, Iowa 51501

[21] Appl. No.: 868,414

[22] Filed: Jan. 10, 1978

[51] Int. Cl.[2] ..... B05B 07/28

[52] U.S. Cl. ..... 222/144.5; 239/307; 239/317; 137/604; 222/148; 222/630

[58] Field of Search ..... 222/144.5, 145, 148, 222/193, 180, 181, 630; 239/113, 307, 310, 317; 137/268, 205.5, 604; 285/331

[56] References Cited

U.S. PATENT DOCUMENTS

| | | | |
|---|---|---|---|
| 1,051,805 | 1/1913 | Danberg | 285/331 X |
| 1,538,395 | 5/1925 | Gane | 285/331 X |
| 2,672,366 | 3/1954 | Deport | 137/604 X |
| 2,711,928 | 6/1955 | Randa | 137/604 X |
| 3,091,402 | 5/1963 | Palmer | 239/317 X |
| 3,454,229 | 7/1969 | Armond | 239/317 |
| 3,902,637 | 9/1975 | Scheeler | 222/144.5 |
| 4,009,672 | 7/1978 | Sheahan et al. | 239/317 |

*Primary Examiner*—Allen N. Knowles
*Assistant Examiner*—Edward M. Wacyra
*Attorney, Agent, or Firm*—Hiram A. Sturges

[57] ABSTRACT

A fluid dispenser for attachment between a water pipe and a shower head having a main stream water passage therethrough into which dispensed fluids flow through a port surrounded by a delivery manifold delivering the fluids from a reservoir assembly from which the fluids flow through valves, the outlet ports of the valves being cleaned to prevent clogging by water flowing past them which reaches them by flow from a bypass opening from the main stream passage upwardly through an in-flow compartment of the manifold which is separated from the out-flow compartment by a weir over which the water flows to direct it at the outlets of the valves, the reservoir assembly with its valves being removable from the delivery manifold for ease of refilling.

14 Claims, 5 Drawing Figures

SHOWER ATTACHABLE DISPENSER

BACKGROUND OF THE INVENTION

In the prior art there have been many proposals for dispensing various fluids into the water stream coming through a shower fixture of a bathroom. They are characterized by having one fault of a very serious nature. They lack means for preventing clogging.

This clogging problem occurs at the ends of spouts and constricted openings which deliver the thick fluids to be admixed with the water flow. Creme rinses and liquid soap are particularly susceptible to clogging.

The clogging problem can be particularly great between the spouts of the right and left valves and delivery manifold surfaces therebeneath.

We prefer that there be a delivery manifold which delivers fluids from the various spouts down to an inlet into the main water stream below. It is desirable that the valve handles be as low as possible so as to be easily reached by short persons. For the latter reason it is desirable that the manifold have the least possible height. This leads to the necessity for the right and left side walls of the manifold to be sharply inwardly inclined from the sides of the valve area so as to sharply inwardly incline toward the inlet to the main water stream.

However, this sharp inclination raises a clogging problem because the spouts at the right and left sides of the unit are then necessarily quite close to the right and left side walls of the manifold, whereby the dispensed fluids have a tendency to drip upon the manifold side walls, and to stick there and clog because of their accumulation whenever such a unit is built as described which has been a prior art way. It is not a satisfactory solution to this problem to make an extremely elongated manifold because the same would place the valves at an extensive height.

We recognize that it is further desirable that the sides of the manifold be as far out of the bather's way as possible. Even if they were inclined at an angle of perhaps 45 degrees they would be more in the way than is necessary. We, therefore, have conceived that the side walls of the manifold are the most out of a bather's way if they are concave. But this very concavity places each side wall of the manifold still closer to the side spouts, and thereby increases the clogging problem, even though the advantages of more room for the bather and lower and more accessible valves are being preserved.

We have discovered a new concept making it possible to have all of these advantages without the great disadvantage of clogging by providing a special auxiliary water flow passing by the lower end of each spout.

We have discovered still another improvement which is the concept of a special notch in a weir disposed behind the spouts, such a notch being directly behind the lower end of a specific spout. With a different notch of this kind for each spout the flow across the spouts is direct and well-aimed for most effective washing of the lower end of the spouts to prevent clogging so that no build-up or accumulation of dried lotions or oils occurs.

We have discovered in testing that all of the different kinds of oils and lotions that we have found to be adviseable to use in such a dispenser have operated free of clogging when the above provisions are used, even though the side walls of the manifold are concave on their undersides and even though the height of the manifold is at minimum for the lowest possible position of the valve handles.

We have conceived that it is desirable that the flow of water be continuously on after the flow of dispensed fluids has been valved off. In this way the water flow across the notches in the weir continues so as to wash the nozzles on after the valves are closed for the various lotions and oils.

Another objective of this invention is to provide the dispenser with the additional feature of transparent fluid reservoir walls so that the user can easily see when to add fluid.

Yet another objective is to provide the dispenser with a lid which can be removed with one single motion for opening up the compartments for all of the fluid and oils at once.

A most important objective is our concept of having a completely removable reservoir and valve module which can be completely taken down off of the permanently attached manifold for the convenience of filling the module chambers with the fluids at a handy level of operations, such as by holding the reservoir module against the chest with the forearm somewhat in the manner of a football quarterback holding a football so that the operator's two hands and one arm are then free for holding a lotion container, unscrewing its cap and tilting the container to fill the reservoirs with a handiness and safety that will insure against spillage.

Still another important feature is the provision of having the valve and reservoir module designed so that its underside is in a horizontal plane so that it can be rested on a table during filling or during sales display at times when it is disassembled.

Yet another of our concepts is to provide the valves in such positions that the valve handles have no part extending down below the bottom of the walls of the reservoir and valve module so that the valve handles themselves do not interfere with the resting of the module on a horizontal surface in an erect and stable manner.

Still another objective is to have the valve spouts themselves terminate at points above the plane of the lowermost sides of the housing of the valve and reservoir module so that the product will rest with stability on a flat surface.

Still a further objective is to provide the valve spouts with inclined lower edges, higher on the rearward side so that the water washing across them strikes the higher side for more effective washing thereof, so that the full force of the water that is washing the spouts is not diminished as much as by portions of the spout itself. One might say that the wash water enters directly into the lower end of the spout because of this inclined lower spout edge feature.

Another object of the invention is to provide a product having beauty. Part of this beauty is achieved by having the right and left side walls of the delivery manifold extending downwardly from the valves, each of a concave shape on its underside as is particularly attractive in frontal elevation, this artistic feature also having the advantage of greater space of movement for the bather because the right and left side walls of the manifold are the more out of the way but having the disadvantage of presenting a clogging danger, which latter is solved, however, as aforesaid.

A particularly important feature is the provision in the delivery manifold of a higher back wall, substantially higher than the forward wall so that water does not tend to flow over the back wall and down between the back wall of the delivery manifold and the back wall of the reservoir and valve module.

In the prior art it is sometimes proposed that dispenser fluids be valved from containers simply held in the shower area but not subject to admixture with the flow of the water as it comes out of the shower. But with such dispensers clogging is a great problem. We all have the experience of how soap tends to accumulate on surfaces. When it obstructs the outlet spout of a valve, then this very quickly causes clogging.

And so one of the particular objectives is to eliminate clogging so that a person need not stand on a chair and reach into a dispenser in some manner which would ordinarily be above the person's head, just in order to try to unclog such a device.

One of the great problems is the valve spouts must be very small. For example, the diameter of a hole of a valve spout is approximately one-eighth of an inch which is a size desirable, yet such small sizes are very cloggable unless special concepts for preventing clogging are available as in this invention.

A particular objective is to carefully select the size of an orifice delivering wash water past the spouts from a main stream. Such an orifice must be very small because the main stream is at a high pressure and the flow up and over the weir and past the spouts must be at a much, much lower pressure. We have discovered that an orifice diameter for this purpose of approximately 25/1000ths of an inch is effective.

A very important feature of the invention is to provide a conduit attachable to the pipe ordinarily receiving a shower head, with the lower end of the conduit receiving the shower head thereon, in which the conduit has a most unusual interior.

We conceive that the interior of the conduit should have an upper portion of larger diameter for lower pressure flow, a central portion of smaller diameter for high pressure flow, and a lower portion of larger diameter for low pressure flow again, at least around the sides of the lower larger diameter area, although, of course, the central part of the lower conduit portion will inevitably be receiving high pressure flow from the constricted central portion of the conduit, with there being an orifice leading from the upper lower flow conduit area into the space behind the weir, so that water through the orifice will flow upwardly because of pressure from water which is held back by the constricted central area of the conduit.

Another objective is to cause the flow of water and dispensed fluids back into the main water stream to be through a hole leading to a lower and larger diametered portion of the main stream conduit so that it enters at the sides of a jet of water spurting out into the lower conduit portion from the constricted central conduit portion, whereby the flow is downward and there is no danger of a back pressure of water up through the dispensed fluids port such as occurs at the water up-flow orifice from the main stream flow.

In the prior art the most common method of delivering the dispensed fluids downwardly into the water stream of a shower has been to have a dispensed fluids container having external threads received in the internal threads of the fixture that mixes the dispensed fluids with the water flow to the shower head. One of the problems with such proposals is that there is spillage waste of the expensive fluids as their upside-down threaded container is applied to the internally threaded fixture.

Still a more serious problem is that many shorter persons reaching up to a shower fixture to screw in a container are not handy at this and they fail to hold the container threads in alignment with the other threads, whereby the threads become "cross-threaded" so that there is a blocking or jamming of the threads, causing frustration. This also leads to more leakage and a nuisance of unscrewing again with still more leakage while the threads are realigned so as to get them straight.

Another solution to the refilling problem is to have large reservoir sections permanently fixed to those parts of the dispenser which remain permanently attached to the plumbing. In that way refilling of the containers is done by pouring fluid into them from the refill-containers purchased from time to time from retail stores. However, this is an inadequate solution. The different members of a family have different desires as regards the types of dispensed fluids they use. With a permanently attached reservoir there is no way to get the children's fluids out of the way in order to fill the reservoir with the fluids for the man of the house. Likewise, the lady of the house wants different fluids than the man and she would have no way of getting the man's fluids out of the way if there were a permanent attachment.

And so we propose multiple reservoir sections which are removable as a unit and replaceable with another reservoir assembly which could contain entirely different fluids. But this gives rise to still a further problem, because the connection of the upper reservoir to the delivery manifold must not only be a removable connection, but also one from which there is no leakage.

This problem we solve by mounting the valves on the reservoir so that they can be shut off, whereby there is no leakage of fluids during reservoir storage, which latter might be far from the shower area.

SUMMARY OF THE INVENTION

A major objective of this invention is to provide a fluid dispenser for attachment between a water pipe and a shower head having a main stream water passage therethrough into which dispensed fluids flow through a port surrounded by a delivery manifold delivering the fluids from a reservoir assembly from which the fluids flow through valves, the outlet ports of the valves being cleaned to prevent clogging by water flowing past them which reaches them by flow from a bypass opening from the main stream passage upwardly through an in-flow compartment of the manifold which is separated from an out-flow compartment by a weir over which the water flows to direct it at the outlets of the valves, the reservoir assembly with its valves being removable from the delivery manifold for ease of refilling.

A further feature is the provision of an annular fluid retaining wall disposed in the in-flow compartment above the bypass opening in a position for baffling the jet force of fluid coming upwardly from the bypass opening to provide a less turbulent flow of fluid downwardly across the weir and across the valve outlet ports.

DESCRIPTION OF THE PREFERRED EMBODIMENT

Figure 1:
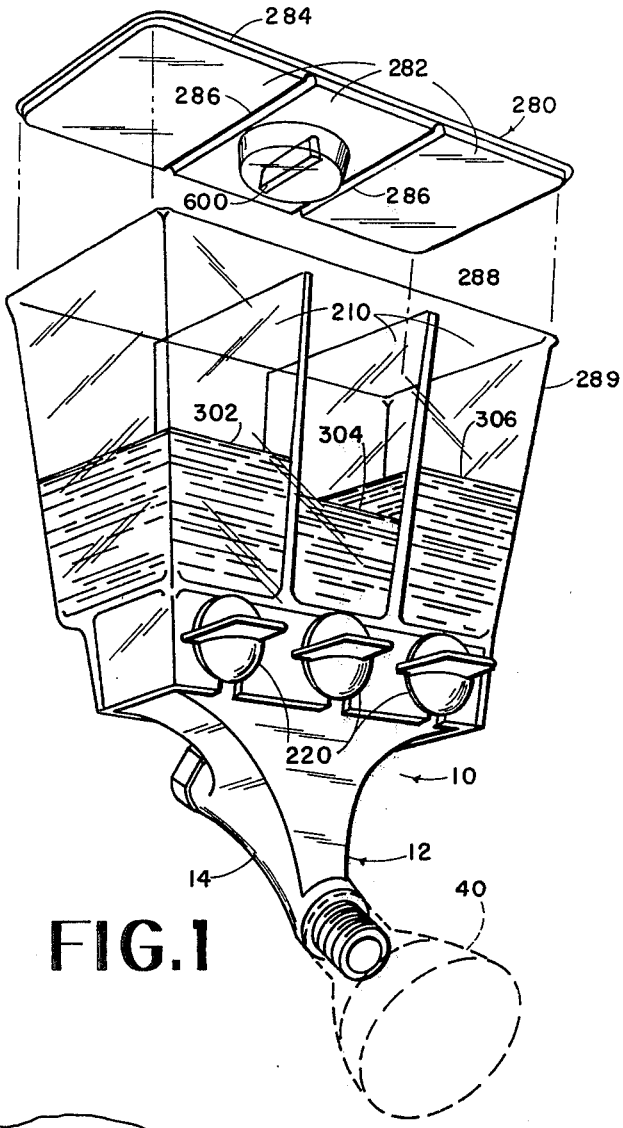
FIG. 1 is a perspective view of the fluid dispenser of this invention shown with fluids therein and with the lid removed, a shower head being shown in dotted lines.
Figure 2:
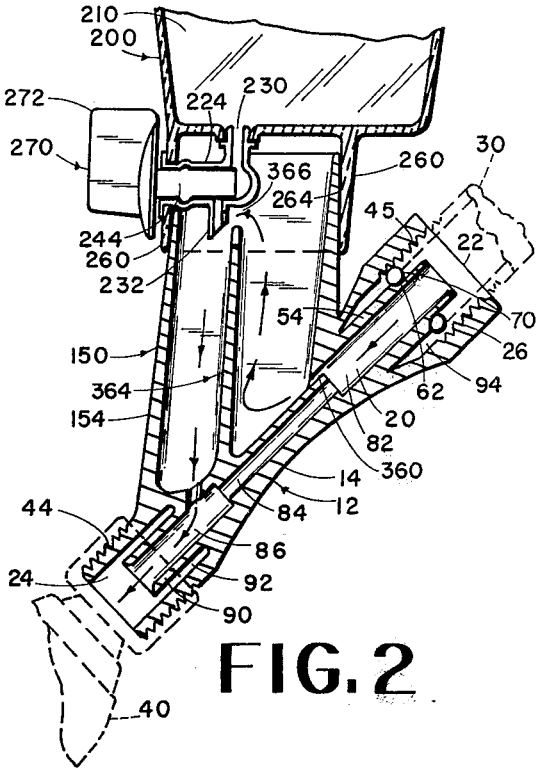
FIG. 2 is a right side elevation of a lower portion of the dispenser of FIG. 1, shown with its right half portion broken away, and with a portion of a pipe and a portion of a shower head shown in dotted lines.

The fluid dispenser of this invention is generally indicated at 10 in FIG. 1, and comprises a flow body, generally indicated at 12, having a water main stream portion 14, best seen in cross section in FIG. 2, the latter having a main stream passage 20 therethrough interconnecting an inlet 22, and an outlet 24.

The inlet 22 is internally threaded at 26 for threaded attachment to the threaded lower end of a water conduit 30, which latter can be the downwardly inclining pipe in a bathroom on which a shower head is conventionally mounted.

A shower head is indicated in dotted lines at 40 and such shower heads normally have an internally threaded upper end portion and so the water main stream portion 14 has a lower externally threaded portion 44 surrounding its outlet 24 for the reception thereon of the shower head 40.

The main stream passage 20 of FIG. 2 has at its upper end a socket 45 on which the threads 26 are disposed.

An upwardly and rearwardly extending annular section 54 of the flow body water main stream portion 14 extends into the socket 45 and has adjacent its upper end, but spaced therefrom, an annular shoulder 62, which latter receives thereon an annular gasket ring 70 of a resilient nature, which latter is adapted to be compressed against the shoulder 62 by the lower end of the conduit 30.

The importance of the annular gasket 70 is to provide a good water-tight seal so that water cannot come out of the upper end of the water main stream portion 14 when it is installed on the shower pipe or conduit 30. The resiliency of the gasket 70 is important because it provides a sealing, even though the conduit 30 may not be fully inserted into the socket 45 at a time when the fluid dispenser 10 is in an upright position, as later described.

The main stream passage 20, therefore, extends through the gasket support 54 in what can be called a larger upper passage section 82 connected to an intermediate passage section 84 of smaller diameter, which latter communicates with a lower passage section 86 of larger diameter.

Inwardly of the outlet 24 is a terminal end of a downwardly projecting annular flow directing portion 90 of the main stream portion 14 of the flow body 12, which serves to keep the water flow more forceful as it flows into the shower head 40, and also provides an annular groove 92 surrounding the annular flow directing portion 90, a similar groove being seen at 94 surrounding the annular portion 54, the grooves 92 and 94 also serving to reduce wall thickness so as to avoid shrinkage of the thermoplastic material, of which the flow body 12 is formed so that it does not distort during manufacture by injection moulding into what would otherwise be an unsightly shape.

The main stream portion 14 of the flow body 12 has a dispensed fluid port 100 extending from the outside thereof to the main stream passage 20 so that dispensed fluids can enter the main water stream.

A fluid delivery manifold 150 has an outer wall 154 attached to and extending upwardly from the main stream portion 14 of the flow body 12, and surrounding the dispensed fluids port 100, so as to deliver fluid thereto.

A reservoir assembly 200 is mounted on the delivery manifold 150 and has a plurality of reservoirs 210 for fluid to be dispensed, each reservoir being adapted to contain a different type of fluid to be mixed with the shower water.

The reservoir assembly has a plurality of valves 220 mounted thereon, and each valve 220 has a valve housing 224, provided with an inlet 230 disposed in communication with a respective reservoir 210, and a valve outlet 232 disposed in communication with the interior of the fluid delivery manifold 150, since the upper side of the wall 154 thereof is open.

Each valve 220 also has a valve opening member 244 rotating in the housing 224 and extending forwardly therefrom outward beyond a downwardly extending annular skirt 260, which extends downwardly from the reservoir assembly 200 and closely surrounds and slidably fits against the outer side of the wall 154 of the fluid delivery manifold 150.

The exterior of the fluid delivery manifold 150 inclines inwardly at its upper end to slidably receive thereagainst an outwardly inclining surface 264 of the skirt 260 for a firm slidable fit with ease of removeability but with stability of support.

The valve closing member 244 is provided with a control knob 272 on its exterior.

A lid 280 is provided with downwardly extending bosses 282, which each snugly fit into the upper end of each reservoir 210 with grooves 286 therebetween receiving upwardly extending divider walls 288, which divide the annular outer wall 289 of the reservoir assembly 200 into separate reservoirs 210.

The lid 282 has an overlapping surrounding ledge 284 which projects horizontally therefrom on all sides for engagement with the upper edges of the wall 289 of the reservoir.

The wall 289 is transparent so that the fluids 302, 304 and 306 therein can be seen therethrough so as to know when to refill.

The divider walls 288 can also be transparent.

Figure 4:
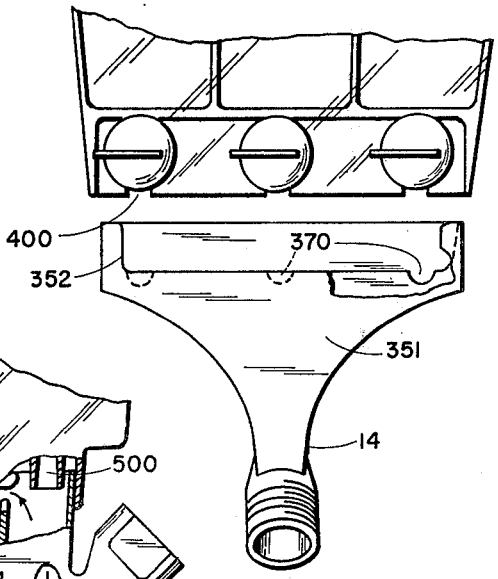
FIG. 4 is a frontal elevation of the dispenser of FIG. 3, but with the reservoir and valve portion thereof removed from the delivery module, the latter being partially broken away and certain notches being shown in dotted lines.

The fluid delivery manifold 150 has a wall 154, the forward side of which is provided with a notch extending downwardly thereinto and extending substantially from the left to the right at the sides thereof for receiving the housing portions 224 of the valves 220, as best seen in FIG. 4.

A bypass opening extends through the main stream portion 14 of the flow body 12, as best seen in FIG. 2 at 360 for delivering fluid from the main stream passage into the rearward side of the fluid delivery manifold 150 so that water can enter for washing across the outlets 232 of the valves to prevent them from clogging.

To assure a proper flow of water a weir 364 extends upwardly from and is attached to the main stream body portion 14 and divides the delivery manifold 150 into an in-flow rearward compartment and an out-flow forward compartment so that water cannot pass from the in-flow compartment to the out-flow compartment without passing across the top 366 of the wier 364, which specifically occurs at certain notches 370, best seen in FIG. 4, each of which is directly behind a respective one of the outlets 232 of the valves 220.

Dispensed fluid and water then flow downwardly through the down-flow compartment to the dispensed fluids port 100 and back into the flow that goes to the shower head 40.

Figure 5:
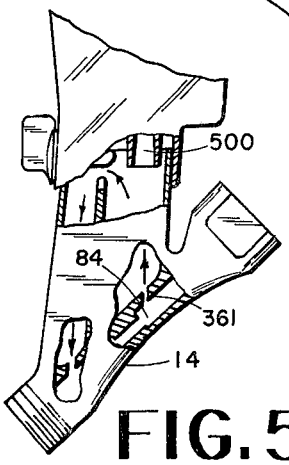
FIG. 5 is a right elevation of a lower portion of a modified fluid dispenser with portions broken away, and other portions shown in section.

In FIG. 5 a modification of the bypass passage 360, is shown at 361, in a position extending substantially vertical so that in making the flow body 12 of thermoplastic material a die element can be inserted into and later withdrawn from the space occupied by the bypass passage 361 means of vertical movement, which can be more easily done through the open upper side of the fluid delivery manifold 150 than it would be to provide tooling for the more downwardly and horizontally extending bypass passage 360 of FIG. 2.

Figure 3:
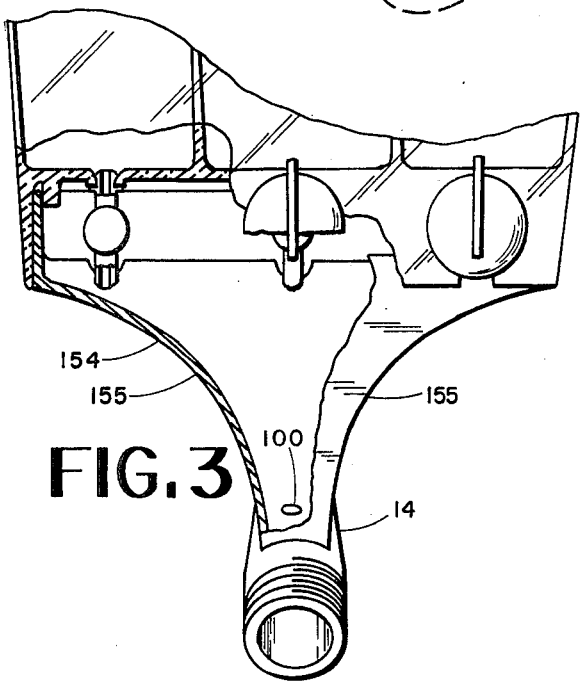
FIG. 3 is a frontal elevation of a lower portion of the fluid dispenser of FIGS. 1 and 2, with parts broken away for showing parts there behind.

Referring to FIG. 3 it will be seen that the right and left sides 155 of the fluid delivery manifold 150 are concave and curved, as seen from the front. This is necessary for attractive appearance, and yet it increases the chances of clogging the valve outlets 232 of the right and left valves 220, because those outlets are close to the side walls 155, as seen in FIG. 3, whereby clogging could otherwise be caused by a build-up of dried out materials being dispensed between the walls 155 and the respective outlets 232 of the right and left side valves 220.

The bypass opening 360 is only 25/1000ths in diameter, whereas the dispensed fluid port 100 is preferably 125/1000ths in diameter. The dispensed fluid port 100 is larger than the bypass opening so as to carry away fluids, including the thicker fluids from the reservoir, without danger of causing overflowing of the manifold.

We claim:

1. A fluid dispenser comprising a flow body having a water main stream portion, said body main stream portion having a main stream inlet adapted to be attached to a water conduit and having a main stream outlet to which a shower head is adapted to be connected, said body main stream portion having a main stream passage interconnecting said inlet and outlet, said body main stream portion having a dispensed fluids port extending therethrough from the upper side thereof to said main stream passage so that dispensed fluids can enter said main stream, a fluid delivery manifold having an outer wall attached to and extending upwardly from said main stream portion of said flow body and surrounding said dispensed fluids port, a reservoir assembly mounted on said delivery manifold and having reservoir means for fluid to be dispensed, a valve means mounted on said reservoir assembly beneath said reservoir means, said valve means having valve inlet means from said reservoir and having valve outlet means in communication with said fluid delivery manifold, said valve means having a housing receiving a valve clogging member movable with respect to said valve housing and with respect to said reservoir means, said valve means having a manual control means attached thereto and disposed exteriorly of said valve housing and on the outer side of said dispenser, said reservoir assembly having a sliding fit with respect to said outer wall of said delivery manifold and being removable upwardly therefrom by being lifted substantially straight upwardly off of said delivery manifold, said valve means being independent of said fluid delivery manifold and being capable of shutting off flow from said reservoir assembly through said valve outlet means, said valve means being removable from said fluid delivery manifold simultaneously with said upward removal of said reservoir assembly from said fluid delivery manifold so that said reservoir means can be removed after said valve means has been shut off to minimize waste of dispensed fluid, said reservoir assembly having filling means thereon in an upper portion thereof.

2. The fluid dispenser of claim 1 in which said main stream body portion is provided with an upwardly extending bypass opening therethrough disposed upstream along said main stream passage from said dispensed fluids port and in communication with the interior of said fluid delivery manifold, a weir attached to said body main stream portion and extending upwardly into said fluid delivery manifold and disposed between said bypass opening and said dispensed fluids port and dividing said fluid delivery manifold into a water up-flow chamber and a water down-flow chamber, the upper side of said weir being disposed in a position for directing the flow of water so that it flows from said up-flow chamber across said weir and across the said valve outlet means and downwardly in said down-flow chamber so as to wash across said valve outlet means and maintain it free of materials that would otherwise collect thereon and cause clogging.

3. The fluid dispenser of claim 2 in which the upper edge of said weir has a notch therein disposed behind said valve outlet means as it specifically directs water flow across said valve outlet means.

4. The fluid dispenser of claim 2 in which a downwardly extending baffle wall extends downwardly from the underside of said reservoir assembly into said in-flow chamber into a position for baffling upwardly flowing water jetting through said bypass opening so as to contain its force for providing a smoother flow of water from said in-flow chamber across said weir.

5. The fluid dispenser of claim 2 in which said main stream passage has a constricted portion between said dispensed fluids port and said by-pass opening so that water will be caused to flow upwardly through said up-flow opening and yet downwardly through said dispensed fluids port.

6. The fluid dispenser of claim 2 in which said dispensed fluids port is larger than said bypass opening.

7. The fluid dispenser of claim 1 in which the outer wall of said reservoir assembly is transparent so that the level of fluids therein is visible therethrough.

8. The fluid dispenser of claim 1 having said flow body main stream portion inlet being provided with internal threads, an annular projection extending up into said inlet and forming a part of said flow body main stream portion, the outer edge of said annular projection receiving a gasket ring of resilient material disposed therearound, said annular projection having an annular shoulder surrounding its outer side and facing upwardly and rearwardly and receiving thereagainst said gasket.

9. The fluid dispenser of claim 1 in which said reservoir assembly has a downwardly extending skirt which latter is slidably received around the outer sides of upper portions of said delivery manifold, said skirt being received tightly against the outer sides of said delivery manifold so as to minimize leakage of water therebetween.

10. The fluid dispenser of claim 9 in which said fluid delivery manifold has a notch in the upper side wall of a forward portion of its said upwardly extending wall, said notch receiving a portion of said valve means as said reservoir is placed downwardly onto said delivery manifold.

11. A fluid dispenser comprising a flow body having a water main stream portion, said body main stream portion having a main stream inlet adapted to be attached to a water conduit and having a main stream outlet to which a shower head is adapted to be connected, said body main stream portion having a main stream passage interconnecting said inlet and outlet, said body main stream portion having a dispensed fluids port extending therethrough from the upper side thereof to said main stream passage so that dispensed fluids can enter said main stream, a fluid delivery manifold having an outer wall attached to and extending upwardly from said main stream portion of said flow body and surrounding said dispensed fluids port, a reservoir assembly mounted on said delivery manifold and having reservoir means for fluid to be dispensed, a valve means mounted on said reservoir assembly beneath said reservoir means, said valve means having valve inlet means from said reservoir and having valve outlet means in communication with said fluid delivery manifold, said valve means being controllable from the outer side of said reservoir assembly, said main stream body portion being provided with an upwardly extending bypass opening therethrough disposed upstream along said main stream passage from said dispensed fluid ports and in communication with the interior of said fluid delivery manifold, a weir attached to said body main stream portion and extending upwardly into said fluid delivery manifold and disposed between said bypass opening and said dispensed fluids port and dividing said fluid delivery into a water up-flow chamber and a water down-flow chamber, the upper side of said weir being disposed in a position for directing the flow of water so that it flows from said up-flow chamber across said weir and across the said valve outlet means and downwardly in said down-flow chamber so as to wash across said valve outlet means and maintain it free of materials that would otherwise collect thereon and cause clogging.

12. The fluid dispenser of claim 11 in which the upper edge of said weir has a notch therein disposed behind said valve outlet means as it specifically directs water flow across said valve outlet means.

13. The fluid dispenser of claim 11 in which said main stream passage has a constricted portion between said dispensed fluids port and said by-pass opening so that water will be caused to flow upwardly through said up-flow opening and yet downwardly through said dispensed fluids port.

14. The fluid dispenser of claim 11 in which said dispensed fluids port is larger than said bypass opening.

* * * * *